US012800265B2

(12) United States Patent
Sonkes et al.

(10) Patent No.: US 12,800,265 B2
(45) Date of Patent: Nov. 17, 2026

(54) FRONT SIGHT BASE

(71) Applicant: BROWNING INTERNATIONAL S.A., Herstal (BE)

(72) Inventors: Olivier Sonkes, Vielsalm (BE); Eric Dassy, Cerexhe-heuseux (BE)

(73) Assignee: BROWNING INTERNATIONAL S.A., Herstal (BE)

( * ) Notice: Subject to any disclaimer, the term of this patent is extended or adjusted under 35 U.S.C. 154(b) by 0 days.

(21) Appl. No.: 19/128,127

(22) PCT Filed: Nov. 17, 2023

(86) PCT No.: PCT/EP2023/082282
§ 371 (c)(1),
(2) Date: May 7, 2025

(87) PCT Pub. No.: WO2024/105261
PCT Pub. Date: May 23, 2024

(65) Prior Publication Data

US 2026/0185799 A1 Jul. 2, 2026

(30) Foreign Application Priority Data

Nov. 18, 2022 (EP) ..... 22208275

(51) Int. Cl.
*F41G 1/02* (2006.01)
*F41A 21/32* (2006.01)

(52) U.S. Cl.
CPC ..... *F41G 1/02* (2013.01); *F41A 21/325* (2013.01)

(58) Field of Classification Search
CPC . F41G 1/02; F41G 1/033; F41G 1/425; F41G 1/44; F41G 11/001; F41G 11/003;
(Continued)

(56) References Cited

U.S. PATENT DOCUMENTS 936,570 A * 10/1909 Saxe ..... F41G 1/26 42/137
2,123,273 A * 7/1938 Burton ..... F41G 1/02 42/127

(Continued)

FOREIGN PATENT DOCUMENTS

WO WO-2019118995 A1 * 6/2019 ..... F41G 1/033

OTHER PUBLICATIONS

International Search Report and Written Opinion of the International Searching Authority from the European Patent Office, in PCT/EP2023/082282 dated Dec. 19, 2023, of which this application is a national phase entry.

*Primary Examiner* — John Cooper
(74) *Attorney, Agent, or Firm* — Kolitch Romano Dascenzo Gates LLP

(57) ABSTRACT

A front sight base for a firearm includes a body having an outer surface and an inner surface which defines a generally cylindrical cavity. The cavity is suitable for receiving a muzzle of a barrel of the firearm. The base is characterized in that the cavity has a female portion that acts as an anti-rotation mechanism when the base is fitted onto the muzzle. The female portion is configured to provide a shaped connection between the female portion and an associated male portion formed on the muzzle so as to prevent rotation between the base and the muzzle while ensuring that the base slides with respect to the muzzle.

22 Claims, 6 Drawing Sheets

(58) Field of Classification Search
CPC ..... F41G 11/004; F41G 11/005; F41A 21/32; F41A 21/325; F41A 21/481
USPC ..... 42/111
See application file for complete search history.

(56) References Cited

U.S. PATENT DOCUMENTS 2,306,176 A * 12/1942 Mathis ..... F41A 21/40 42/79
2,367,342 A * 1/1945 Halvor ..... F41G 1/01 42/136
2,380,965 A * 8/1945 Harvey ..... F41G 1/02 42/148
2,645,017 A * 7/1953 Haase ..... F41G 1/02 42/143
2,932,896 A * 4/1960 Hicinbothem ..... F41G 1/04 42/130
3,646,682 A * 3/1972 Edwin ..... F41G 1/02 42/144
3,648,374 A * 3/1972 Lewis ..... F41G 1/033 42/136
5,068,968 A * 12/1991 Sillery ..... F41G 1/02 89/200
5,590,484 A * 1/1997 Mooney ..... F41G 1/16 42/111
7,624,527 B2 * 12/2009 Casas Salva ..... F41G 1/02 42/111

* cited by examiner

FRONT SIGHT BASE

TECHNICAL FIELD

The present disclosure relates to the field of firearms and more particularly to a front sight base, a front sight, and a firearm adapted to or equipped with this front sight base or front sight.

BACKGROUND

Conventionally, the front sight is attached to the muzzle of the barrel by means of fastening screws tightened with a wrench. This operation takes time, not only to pre-position the front sight but also to screw and then tighten the fastening screws. U.S. Pat. Nos. 2,123,273 and 5,068,968 disclose a front sight base with separate anti-rotation means and retaining means.

SUMMARY

The present disclosure aims to overcome at least one of the drawbacks of the prior art. More specifically, the present disclosure aims to simplify the mounting of the sight.

The present disclosure relates to a front sight base for a firearm, said base comprising a body having an outer surface and an inner surface which defines a generally cylindrical cavity, said cavity being adapted to receive a muzzle of a barrel of the firearm, said base being characterized in that the cavity comprises a female portion that acts as an anti-rotation means when said base is fitted on said muzzle and is configured in such a way as to provide a shaped connection between the female portion of the base and an associated male portion formed on the muzzle in such a way as to prevent rotation between said base and said muzzle while ensuring sliding of said base with respect to the muzzle.

According to an advantageous embodiment of the present disclosure, the base comprises one or more of the following technical features, in any possible suitable combination:

- the inner surface of said base comprises:
  - a first sliding and anti-rotation guide surface, preferably a first flat surface, in particular a first flattened area,
  - and optionally at least one substantially cylindrical, preferably cylindrical, portion,
  - and optionally a second sliding and anti-rotation guide surface, preferably a second flat surface, in particular a second flattened area;
- said base further comprises a retaining means capable of rigidly securing said base to the firearm;
- said retaining means comprising a pre-stressed retractable means adapted to be pressed onto a track formed on the muzzle of the firearm when said muzzle is fitted in said base;
- said track is opposite the first sliding and anti-rotation guide surface of the inner surface of the base when said muzzle is fitted in said base;
- the female portion that acts as an anti-rotation means has a section without symmetry of revolution;
- the pre-stressed retractable means comprises or consists of a load spring, such as a leaf with a first portion serving as an elastic element and a second portion serving as a retaining element, said second portion preferably being an end or an intermediate portion of the leaf, said leaf being at least partially rolled up or curved, the base preferably comprising a chamber, in which the load spring is arranged, said chamber opening into the cavity;

- the pre-stressed retractable means comprises a spring, such as a leaf spring and a movable element, such as a roller serving as a retaining element, the base further comprising a chamber, in which the movable element and the spring are arranged, said chamber opening into the cavity, said movable element preferably being retained by grooves arranged in said chamber;
- the track comprises a first sliding and anti-rotation guide surface, preferably a first flat surface, in particular a first flattened area;
- the track formed on the muzzle of the firearm is a first track of said muzzle, the pre-stressed retractable means is a first pre-stressed retractable means, and the retaining means comprises a second pre-stressed retractable means adapted to be pressed onto a corresponding second track formed on the muzzle of the firearm when said muzzle is fitted in said base and in that the second track is opposite the second sliding and anti-rotation guide surface of the inner surface of the base when said muzzle is fitted in said base;
- the second track comprises a second sliding and anti-rotation guide surface, preferably a second flat surface, in particular a second flattened area;
- the second pre-stressed retractable means comprises or consists of a load spring, such as a leaf with a first portion serving as an elastic element and a second portion serving as a retaining element, said second portion preferably being an end or an intermediate portion of the leaf, said leaf being at least partially rolled up or curved, forming the retaining protrusion, the base preferably comprising a dedicated chamber, in which the load spring is arranged, said chamber opening into the cavity;
- an extension toward the rear of the muzzle of the barrel, adapted to rest on a portion of the barrel, said extension comprising a damping element housed in the extension, said damping element preferably being an elastomer plug, said damping element making it possible to avoid direct contact between a face of the extension opposite the firearm and said portion when the base is mounted on said firearm.

The present disclosure also relates to a firearm front sight comprising a base according to the present disclosure and a sight attached to said base.

The present disclosure also relates to a firearm adapted to receive the base according to the present disclosure, characterized in that the muzzle comprises an outer surface, a portion of which, referred to as the "associated male portion", acts as an anti-rotation means when said base is fitted on said muzzle, said female portion of the base and the associated male portion of the muzzle providing a shaped connection preventing rotation between said base and said muzzle while ensuring sliding of said base with respect to the muzzle.

According to an advantageous embodiment of the present disclosure, the firearm comprises one or more of the following technical features, in any possible suitable combination:

- the associated male portion that acts as an anti-rotation means comprises:
  - a track comprising a first sliding and anti-rotation guide surface, preferably a first flat surface, in particular a first flattened area, preferably machined on the muzzle of the barrel;
  - and optionally at least one substantially cylindrical, preferably cylindrical, portion;

the track comprises a notch preferably acting as a receptacle for the retaining element or means, when the base is fitted on the muzzle;

said track is a first track and the associated male portion that acts as an anti-rotation means further comprises a second track comprising a second sliding and anti-rotation guide surface, preferably a second flat surface, in particular a second flattened area, preferably machined on the muzzle;

the muzzle comprises an attachment interface, in particular a thread, adapted to attach an accessory, such as a muzzle brake or silencer, said firearm further comprising a protective ring attached to the muzzle, in particular tightened on said thread, said firearm and said base being adapted such that the protective ring blocks the base in translation.

The present disclosure also relates to a firearm according to the present disclosure equipped with a base according to the present disclosure or a front sight according to the present disclosure.

The present disclosure also relates to a firearm comprising a front sight base, said base being removable and comprising a body having an outer surface and an inner surface which receives a muzzle of a barrel of the firearm, said base comprising a retaining means capable of rigidly securing said base to the firearm, said base being such that the inner surface comprises a female portion that acts as an anti-rotation means, said base being configured in such a way as to provide a shaped connection between the female portion of the base and an associated male portion formed on the muzzle in such a way as to prevent rotation between said base and said muzzle while ensuring sliding of said base with respect to the muzzle when said base is not rigidly secured to the firearm by said retaining means, the inner surface of the base optionally comprising:

a first sliding and anti-rotation guide surface, preferably a first flat surface, in particular a first flattened area, and optionally at least one substantially cylindrical, preferably cylindrical, portion, and optionally a second sliding and anti-rotation guide surface, preferably a second flat surface, in particular a second flattened area, optionally said muzzle comprising an outer surface, the portion of which referred to as the "associated male portion", acts as an anti-rotation means, said associated male portion comprising:

a first track comprising a first sliding and anti-rotation guide surface, preferably a first flat surface, in particular a first flattened area, and optionally at least one substantially cylindrical, preferably cylindrical, portion, and optionally a second track comprising a second sliding and anti-rotation guide surface, preferably a second flat surface, in particular a second flattened area, the retaining means comprising a pre-stressed retractable means adapted to be pressed onto the first track of the muzzle of the firearm, characterized in that said first track is opposite the first sliding and anti-rotation guide surface of the inner surface of the base.

According to an advantageous embodiment of the present disclosure, the firearm comprises one or more of the following technical features, in any possible suitable combination:

said second track is opposite the second sliding and anti-rotation guide surface formed on the first inner surface of the base;

the pre-stressed retractable means comprises or consists of a load spring, such as a leaf with a first portion serving as an elastic element and a second portion serving as a retaining element, said second portion preferably being an end or an intermediate portion of the leaf, said leaf being at least partially rolled up or curved, the base preferably comprising a chamber, in which the load spring is arranged, said chamber opening onto the first track;

the pre-stressed retractable means comprises a spring, such as a leaf spring and a movable element, such as a roller serving as a retaining element or means, the base further comprising a chamber, in which the movable element and the spring are arranged, said chamber opening onto the first track, said movable element preferably being retained by grooves arranged in said chamber;

said first track comprises a notch, preferably acting as a receptacle for the retaining element or means;

the pre-stressed retractable means is a first pre-stressed retractable means and the retaining means comprises a second pre-stressed retractable means adapted to be pressed onto the corresponding second track formed on the muzzle of the firearm;

the second pre-stressed retractable means comprises or consists of a load spring, such as a leaf with a first portion serving as an elastic element and a second portion serving as a retaining element, said second portion preferably being an end or an intermediate portion of the leaf, said leaf being at least partially rolled up or curved, the base preferably comprising a dedicated chamber, in which the load spring is arranged, said chamber opening into the cavity;

said base comprises an extension toward the rear of the muzzle of the barrel, adapted to rest on a portion of the barrel, said extension comprising a damping element housed in the extension, said damping element preferably being an elastomer plug, said damping element making it possible to avoid direct contact between a face of the extension opposite the firearm and said portion;

a sight is attached to said base;

the muzzle comprises an attachment interface, in particular a thread, adapted to attach an accessory, such as a muzzle brake or silencer, said firearm further comprising a protective ring attached to the muzzle (210), in particular tightened on said thread, said firearm and said base being adapted such that the protective ring blocks the base in translation.

In general, the advantageous embodiments of each subject of the present disclosure are also applicable to the other subjects of the present disclosure. As far as possible, each subject of the present disclosure may be combined with other subjects. The subjects of the present disclosure may also be combined with the embodiments of the description, which may moreover be combined with one another.

The measures of the present disclosure are advantageous in that no tools for mounting or removing the front sight are required. They are modular, facilitating mounting of other types of sights or rings. They simplify operations so that the end customer does not need to go to a gunsmith. In particular, assembly is very quick.

BRIEF DESCRIPTION OF THE DRAWINGS

Further features and advantages of the present disclosure will be understood more clearly from the description and the drawings.

DETAILED DESCRIPTION

Figure 1A:
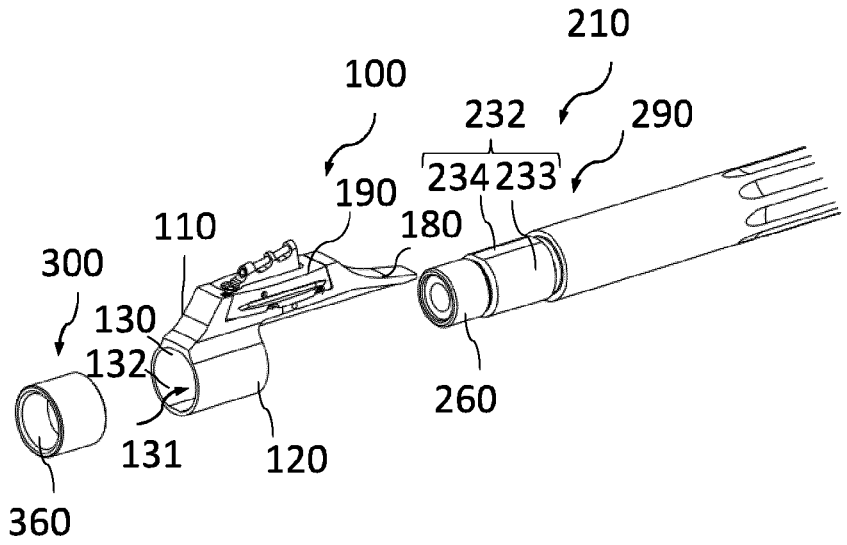
FIG. 1A shows a perspective view of a front sight and a firearm before the front sight is fitted on the firearm, according to a first embodiment.

FIG. 1A shows a perspective view of a front sight 100 and a firearm before the front sight is fitted on the muzzle 210 of the firearm. In this first embodiment, the front sight 100 comprises a base 110 and a sight 190 attached thereto. The base 110 comprises a body having an outer surface 120 and an inner surface 130 which defines a generally cylindrical cavity 131. The cavity 131 is adapted to receive a muzzle 210 of a barrel of the firearm.

In FIG. 1A, a portion of the outer surface 232 of the muzzle 210 acts as an anti-rotation means when the base 110 is fitted on the muzzle. To this end, at least a portion 132 of the inner surface of the base 110 interacts with the associated portion 232 of the outer surface of the muzzle 210 in such a way as to provide a shaped connection preventing rotation between the base 110 and the muzzle 210 while ensuring sliding of the base 110 with respect to the muzzle 210. The portion of the outer surface 232 of the muzzle that acts as an anti-rotation means preferably comprises a machined first upper flattened area 234 and a second lower flattened area 234' (shown in FIG. 2B). This design is practical because it requires minimal machining. A single flattened area or more than two flattened areas can serve as an alternative, as can other shapes providing a shaped connection such as one or more splines.

In FIG. 1A, the muzzle 210 of the firearm comprises a thread 260, adapted to attach an accessory, such as a muzzle brake or silencer. In FIG. 1A, a protective ring 300 with an inner thread 360 is provided to be screwed onto the thread 260 of the muzzle 210 in such a way that the protective ring 300 blocks the base 110 in translation once assembled. Although a threaded connection is considered to constitute an advantageous embodiment, other means of connection may be envisaged, such as a bayonet connection.

In FIG. 1A, it can be seen that the protective ring 300 is adapted to bear against one end of the front sight base 110 and that the other end of the base 110 is adapted to bear against a shoulder machined on the muzzle 210 of the firearm.

In FIG. 1A, the sight 190 comprises an optical fiber, the orientation of which is adjustable.

Figure 1B:
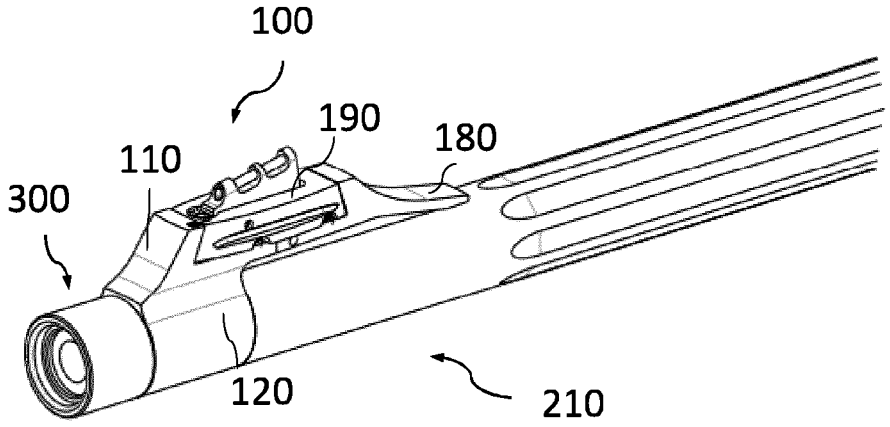
FIG. 1B is a perspective view showing the front sight, the firearm and a protective ring once assembled, according to the first embodiment.

FIG. 1B is a perspective view showing the front sight 100, the firearm and the protective ring 300 shown in FIG. 1A, once assembled. In FIG. 1B, it can be seen that the protective ring 300 bears against the front end of the front sight base 110 and that the rear end of the base 110 bears against the shoulder machined on the muzzle 210, preventing any translational movement of the front sight 100.

Figure 2A:
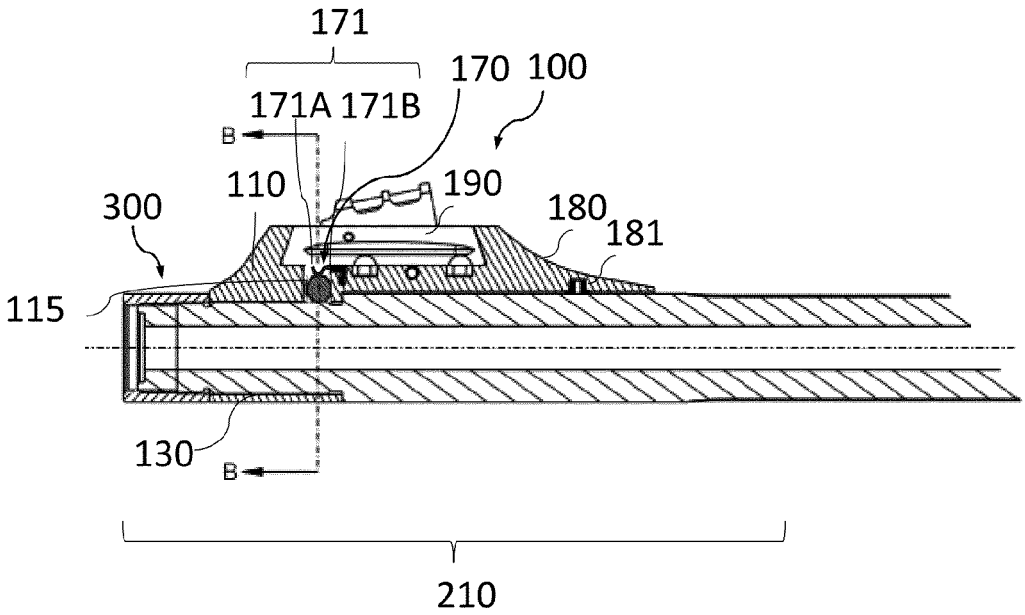
FIG. 2A shows a partial longitudinal section through the firearm equipped with its front sight and the protective ring, according to the first embodiment.

FIG. 2A shows a longitudinal section through the base 110 and the firearm, as well as the protective ring 300 once assembled as in FIG. 1B. However, FIG. 2A shows a side view of the sight 190 in FIG. 2A.

Figure 2B:
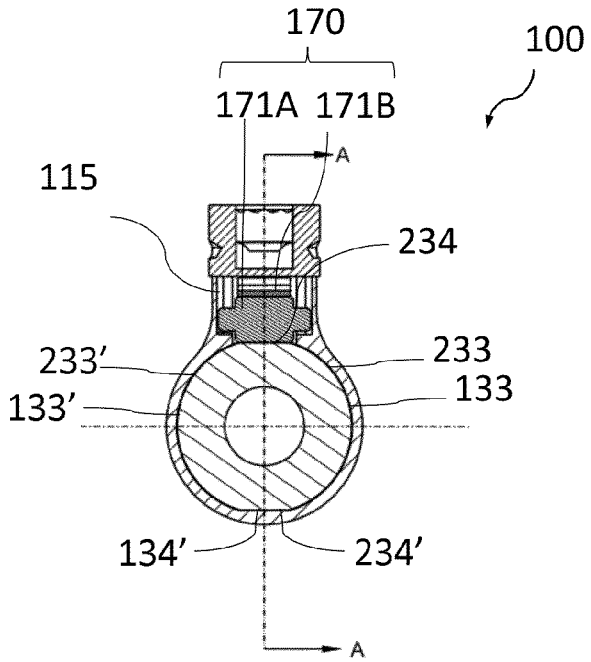
FIG. 2B shows a cross section through the firearm equipped with its front sight, according to the first embodiment.

In an advantageous embodiment of the present disclosure, the base 110 may comprise a retaining means 170 that rigidly secures the base 110 to the firearm as shown in FIG. 2B. The retaining means 170 may comprise a pre-stressed retractable means 171 adapted to be pressed onto a track 234 formed on said firearm, in particular the upper flattened area 234.

Figure 3:
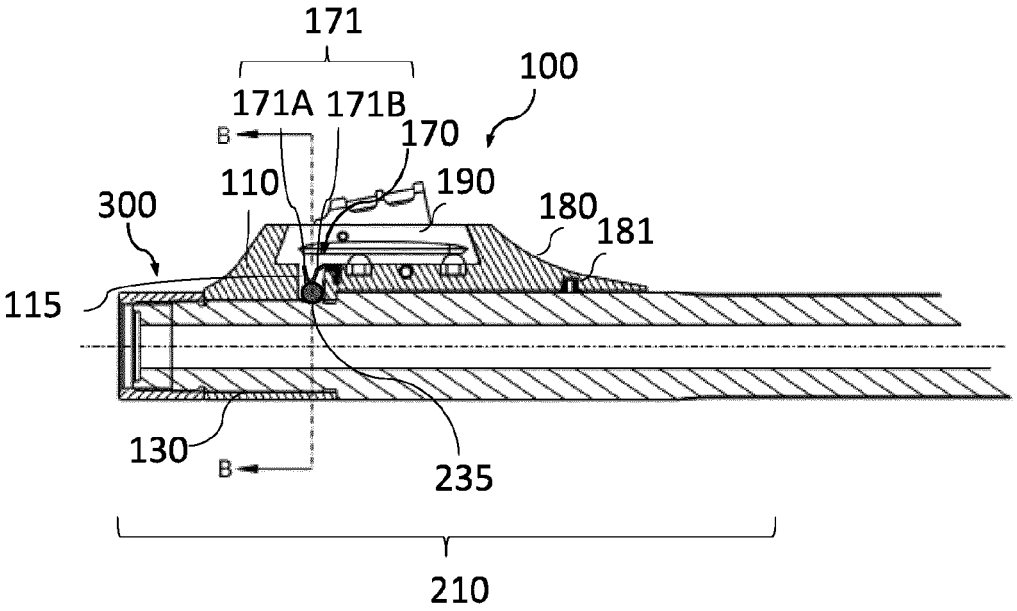
FIG. 3 shows a partial longitudinal section through a firearm equipped with its front sight and a protective ring, according to a second embodiment.
Figure 4:
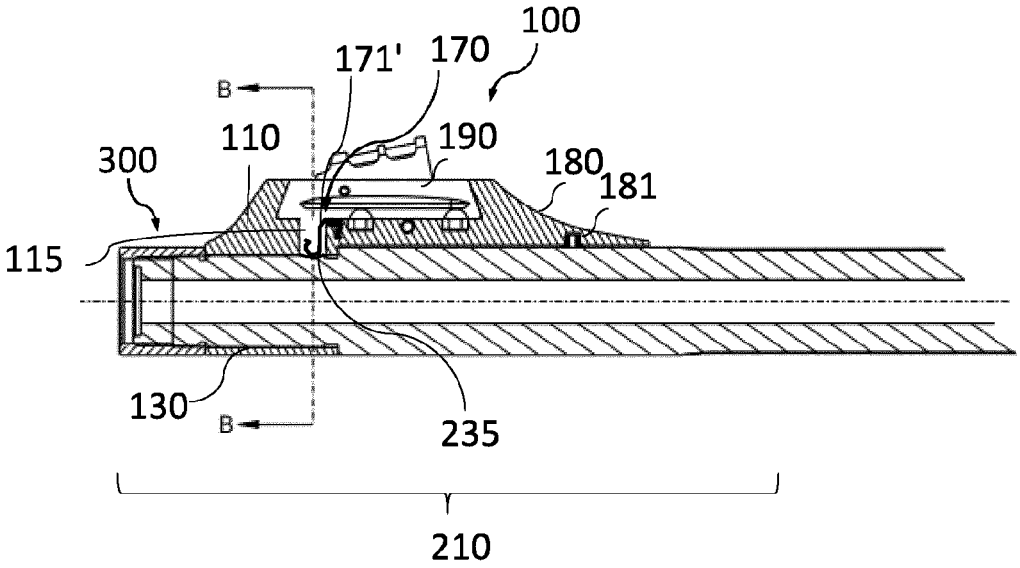
FIG. 4 shows a partial longitudinal section through a firearm equipped with its front sight and a protective ring, according to a third embodiment.

In an advantageous embodiment of the present disclosure, the pre-stressed retractable means 171 comprises a roller 171A and a spring in the form of a leaf 171B. This configuration makes it possible to have a robust and reliable retaining means 170. Moreover, this device is simple. To be specific, the base 110 can be easily disengaged when a removal force is applied in the direction of sliding on the base 110. Advantageously, the force applied by the spring 171B on the roller 171A may be adjusted such that it is sufficient to hold the base 110 on the barrel when firing without the protective ring 300. Assembly takes just a few seconds because all that is required is to overcome the force applied on the roller 171A to slide the front sight to be mounted/removed outward or inward. Alternatively, the pre-stressed retractable means may comprise a leaf, a portion of which bears on the track as shown in FIG. 4. Advantageously, the track comprises a notch 235 acting as a receptacle for the pre-stressed retractable means when the roller is at the end of its travel in order to increase the removal force for disengaging the base 110 and thus improve safety as shown in FIGS. 3 and 4. Advantageously, a quick release connection such as a lever or with a push button, preferably positioned in an upper portion of the base, may be envisaged.

As shown in FIG. 2A, the base 110 may comprise an extension 180 adapted to rest on a portion of the firearm, in particular a portion of the outer surface of the muzzle 210, said portion being arranged upstream (at the rear) of the portion that acts as an anti-rotation means, by means of a damping element 181 housed in the extension making it possible to avoid direct contact between a face of the extension opposite the firearm and said firearm, and consequently any marking between the metal parts during mounting/removing. Preferably, the damping element 181 is an elastomer plug which comprises a head bearing against the firearm in use and a body preferably provided with one or more peripheral ribs.

Figure 5:
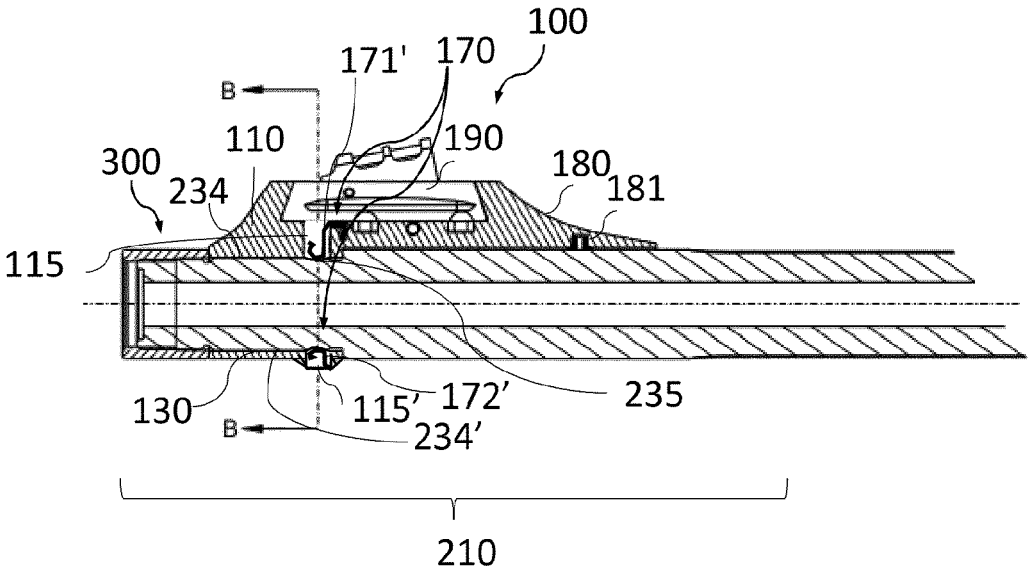
FIG. 5 shows a partial longitudinal section through a firearm equipped with its front sight and a protective ring, according to a fourth embodiment.

When being fitted, the front sight slides onto the front part of the barrel. The roller 171A placed under stress has the function of engaging on the upper flattened area 234 machined on the muzzle of the barrel and holding said front sight 100 in place. The protective ring 300 of the thread 260 may then be attached and thus blocks any translational movement of the base 110 and therefore any accidental disassembly. In the preferred embodiment, the roller 171A or the leaf 171', 171B bears on an upper flattened area 234. However, a roller or a leaf, alone or in combination with the upper retaining means, in particular the leaf 171B, 171' or the roller 171A arranged against the upper flattened area 234, could bear on a lower flattened area 234'. FIG. 5 shows a retaining means comprising two pre-stressed retractable means, namely an upper leaf 171' and a lower leaf 172'. Alternatively, two opposite lateral flattened areas bearing respectively against two rollers or leaves may be provided. Furthermore, more than two flattened areas may be envisaged, for example a combination of opposite lateral flattened areas with lower and upper flattened areas.

As shown in FIG. 2B, the base 110 further comprises a chamber 115 in which the roller 171A and the leaf spring 171B are arranged. The chamber 115 opens into the cavity 131 in the base 110, said roller 171A being retained by grooves arranged in said chamber 115.

FIG. 3 shows a second embodiment which differs from the first embodiment in that the upper flattened area 234 comprises a notch 235 acting as a receptacle for the roller 171A, when the base 110 is fitted on the muzzle 210. Advantageously, the clearance formed at the foot of the shoulder machined on the muzzle 210 may act as a receptacle for the retaining means (e.g. the protrusion or element referred to as a retaining element). This particular embodiment is not shown in FIG. 3.

FIG. 4 shows a third embodiment which differs from the second embodiment in that the pre-stressed retractable means is a leaf 171', one end of which is partially rolled up, forming a protrusion or a retaining and bearing element. In this embodiment it is not necessary to have grooves to retain the roller 171A.

FIG. 5 shows a fourth embodiment which differs from the third embodiment in that an additional pre-stressed retractable means 172' is provided. This means bears against the second lower flattened area 234' of the muzzle 210.

Figure 6A:
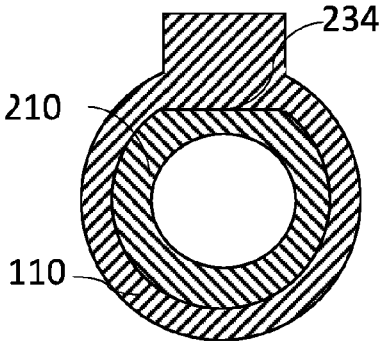
FIGS. 6A, 6B, 6C, 6D, 6E, 6F, 6G and 6H show that it is possible to generalize the shape of the section of the female portion of the base that acts as an anti-rotation means as well as the shape of one or more tracks associated with the retaining means.
Figure 6E:
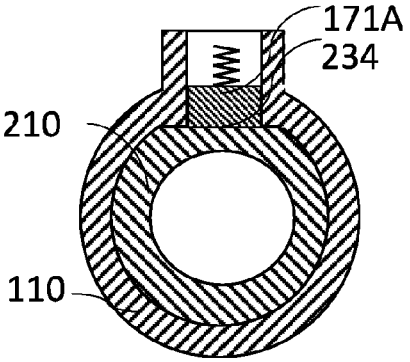
Figure 6B:
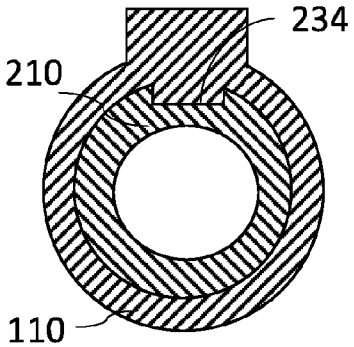
Figure 6F:
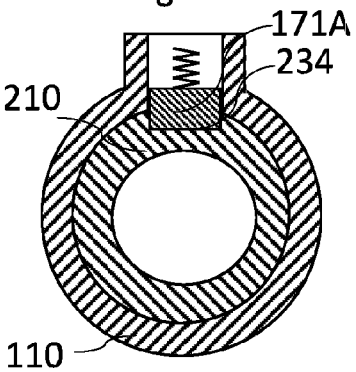
Figure 6C:
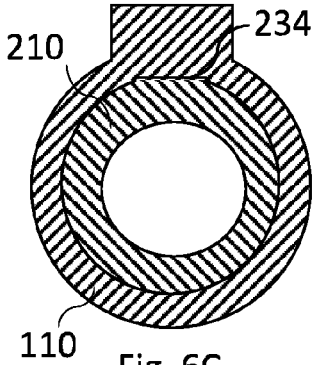
Figure 6G:
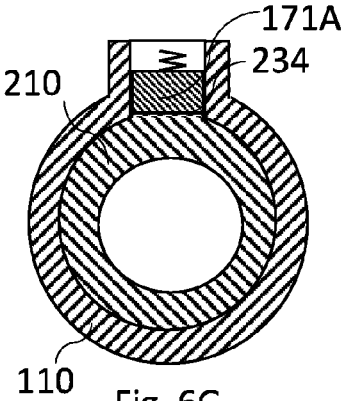
Figure 6D:
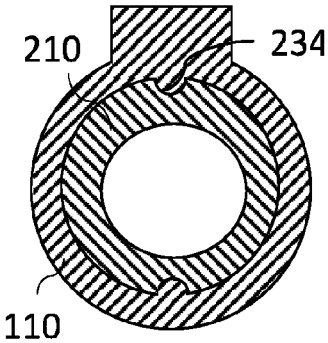
Figure 6H:
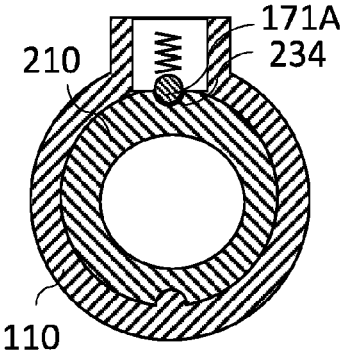

FIGS. 6A, 6B and 6C show that it is possible to generalize the shape of the section of the female portion of the base that acts as a sliding anti-rotation means, as described in the preceding embodiments. To be specific, the flattened area on the base and the corresponding flattened area 234 on the muzzle shown in FIG. 6A may be modified into two sliding and anti-rotation guide surfaces, in particular a first flat surface belonging to a tongue or a r/groove formed on the base 110 and a second surface 234 (opposite the first) belonging to a r/groove or tongue formed on the muzzle 210, as shown respectively in FIG. 6B or 6C, respectively. However, these modifications may require further machining but may be justified depending on the circumstances. Furthermore, they may be positioned at the bottom as an alternative or complementary solution to positioning them at the top. As shown in FIG. 6D, first and second sliding and anti-rotation guide surfaces may have a non-flat surface, in particular a semi-cylindrical shape. FIGS. 6E, 6F, 6G and 6H relate to FIGS. 6A, 6B, 6C and 6D respectively, except that they show a section through the retaining means. FIGS. 6E, 6F and 6G show a section through a cylindrical roller, while FIG. 6H shows a section through a spherical roller. Not shown, a leaf bearing on the sliding and anti-rotation guide surface 234 formed on the muzzle 210 may be used instead of the optionally spherical roller.

A "sliding and anti-rotation guide surface" of an inner surface referred to as female means a portion of a surface the shape of which does not coincide with a cylindrical shape. This shape makes it possible to prevent the rotation of a portion referred to as "male" having a shape corresponding to the inner surface. Furthermore, the sliding and anti-rotation guide surface also allows sliding between the portion referred to as "male" and the inner surface referred to as "female". A sliding and anti-rotation guide surface may be a flat surface, preferably a flattened area. This term described in combination with an inner surface may also apply to a portion referred to as "male".

Moreover, the description comprises embodiments of the present disclosure according to the following clauses:

1. A front sight base (110) for a firearm, said base (110) comprising a body having an outer surface (120) and an inner surface (130) which defines a generally cylindrical cavity (131), said cavity (131) being adapted to receive a muzzle (210) of a barrel of the firearm, said base (110) being characterized in that the cavity comprises a female portion (132) that acts as an anti-rotation means when said base (110) is fitted on said muzzle (210) and is configured in such a way as to provide a shaped connection between the female portion of the base (110) and an associated male portion formed on the muzzle (210) in such a way as to prevent rotation between said base (110) and said muzzle (210) while ensuring sliding of said base (110) with respect to the muzzle (210).

2. The base (110) of the preceding clause, characterized in that the female portion (132) that acts as an anti-rotation means has a section without symmetry of revolution.

3. The base (110) of clause 1 or 2, comprising a first flattened area (134) and optionally a second flattened area (134') and at least one substantially cylindrical, preferably cylindrical, portion (133, 133').

4. The base (110) of one of the preceding clauses, further comprising a retaining means (170) capable of rigidly securing said base (110) to the firearm.

5. The base (110) of one of the preceding clauses, characterized in that the retaining means (170) comprises one (171, 171', 172') or more pre-stressed retractable means (171, 171', 172'), in particular a first and a second means adapted to be pressed onto one (234) or more tracks (234, 234'), in particular a first and a second corresponding tracks formed on the muzzle of the firearm when said muzzle is fitted in said base (110).

6. The base (110) of clauses 5 and 3, characterized in that the track (234) or the several tracks (234, 234') bear against the or are opposite the first flattened area (134) or the corresponding flattened areas (134; 134') of the inner surface of the base (110) when said muzzle is fitted in said base (110).

7. The base (110) of either of clauses 5 and 6, characterized in that the track (234) or at least one of the tracks comprises a notch (235) acting as a receptacle for a retaining protrusion when the base (110) is fitted on the muzzle (210), said protrusion being formed on the or at least one of the pre-stressed retractable means.

8. The base (110) of the preceding clause, characterized in that the one or more pre-stressed retractable means comprise or consist of a load spring (171', 172'), such as a leaf with a first portion serving as an elastic element and a second portion, preferably an end or an intermediate portion of the leaf being at least partially rolled up or curved, forming the retaining protrusion, the base (110) preferably further comprising one or more chambers (115, 115'), in which the corresponding load spring or springs (171', 173') are arranged, said chamber or chambers (115, 115') opening into the cavity (131).

9. The base (110) of clause 7, characterized in that the pre-stressed retractable means (171) comprises a spring (171B), such as a leaf spring (171B) and a movable element (171A), such as a roller (171A) serving as a retaining means (170), the base (110) further comprising a chamber (115), in which the movable element (171A) and the spring (171B) are arranged, said chamber (115) opening into the cavity (131), said movable element being retained by grooves arranged in said chamber (115).

10. The base (110) of one of the preceding clauses, comprising an extension (180) toward the rear of the muzzle of the barrel, adapted to rest on a portion (290) of the barrel, said extension (180) comprising a damping element (181) housed in the extension (180), said damping element (181) preferably being an elastomer plug, said damping element (181) making it possible to avoid direct contact between a face of the extension opposite the firearm and said portion (290) when the base (110) is mounted on said firearm.

11. A firearm front sight (100) comprising a base (110) of one of clauses 1 to 10 and a sight (190) attached to said base (110).

12. A firearm adapted to receive the base (110) of one of the preceding clauses, characterized in that the muzzle (210) comprises an outer surface, a portion (232) of which, referred to as the "associated male portion", acts as an anti-rotation means when said base (110) is fitted on said muzzle (210), said female portion (132) of the base (110) and the associated male portion of the muzzle (210) providing a shaped connection preventing rotation between said base (110) and said muzzle (210) while ensuring sliding of said base (110) with respect to the muzzle (210).

13. The firearm of the preceding clause, characterized in that the associated male portion (232) that acts as an anti-rotation means comprises a first flattened area (234) and optionally a second flattened area (234'), preferably machined on the muzzle (210) of the barrel, and at least one cylindrical portion (233, 233').

14. The firearm of the preceding clause and adapted to receive the base (110) of one of clauses 5 to 10, characterized in that the associated male portion (232) that acts as an anti-rotation means of the muzzle (210) further comprises the track (234).

15. The firearm of clause 13 or 14 and adapted to receive the base (110) of one of clauses 5 to 10, characterized in that the track (234) or at least one of the several tracks comprises a notch (235) acting as a receptacle for a retaining protrusion formed on the or at least one of the pre-stressed retractable means when the base (110) is fitted on the muzzle (210).

16. The firearm of one of clauses 13 to 15 and adapted to receive the base (110) of one of clauses 5 to 10, characterized in that the first flattened area (234) of the muzzle (210) defines the track (234).

17. The firearm of clause 15 and adapted to receive the base (110) of clause 6, characterized in that the first flattened area (234) and the second flattened area (234') of the muzzle (210) define the first track (234) and the second track (234'), respectively.

18. The firearm of one of clauses 12 to 17, characterized in that the muzzle (210) comprises an attachment interface (260), in particular a thread (260), adapted to attach an accessory, such as a muzzle brake or silencer, said firearm further comprising a protective ring (300) attached to the muzzle (210), in particular tightened on said thread (260), said firearm and said base (110) being adapted such that the protective ring (300) blocks the base (110) in translation.

19. A firearm of one of clauses 12 to 18, equipped with a base (110) of one of clauses 1 to 10, or with a front sight of clause 11.

Moreover, the description comprises embodiments of the present disclosure according to the following clauses:

1. A front sight base (110) for a firearm, said base (110) comprising a body having an outer surface (120) and an inner surface (130) which defines a generally cylindrical cavity (131), said cavity (131) being adapted to receive a muzzle (210) of a barrel of the firearm, said base (110) being characterized in that the cavity comprises a female portion (132) that acts as an anti-rotation means when said base (110) is fitted on said muzzle (210) and is configured in such a way as to provide a shaped connection between the female portion (132) of the base (110) and an associated male portion (232) formed on the muzzle (210) in such a way as to prevent rotation between said base (110) and said muzzle (210) while ensuring sliding of said base (110) with respect to the muzzle (210).

2. The base (110) of the preceding clause, characterized in that the female portion (132) that acts as an anti-rotation means has a section without symmetry of revolution.

3. The base (110) of clause 1 or 2, comprising a first flattened area (134) and optionally a second flattened area (134') and at least one substantially cylindrical, preferably cylindrical, portion (133, 133').

4. The base (110) of one of the preceding clauses, further comprising a retaining means (170) capable of rigidly securing said base (110) to the firearm.

5. The base (110) of one of the preceding clauses, characterized in that the retaining means (170) comprises a pre-stressed retractable means (171, 171') adapted to be pressed onto a track (234) formed on the muzzle of the firearm when said muzzle is fitted in said base (110).

6. The base (110) of clauses 5 and 3, characterized in that the track (234) bears against the or is opposite the first flattened area (134) of the inner surface of the base (110) when said muzzle is fitted in said base (110).

7. The base (110) of the preceding clause, characterized in that the pre-stressed retractable means (171) comprises a spring (171B), such as a leaf spring (171B) and a movable element (171A), such as a roller (171A) serving as a retaining means (170), the base (110) further comprising a chamber (115), in which the movable element (171A) and the spring (171B) are arranged, said chamber (115) opening into the cavity (131), said movable element being retained by grooves arranged in said chamber (115).

8. The base (110) of one of the preceding clauses, comprising an extension (180) toward the rear of the muzzle of the barrel, adapted to rest on a portion (290) of the barrel, said extension (180) comprising a damping element (181) housed in the extension (180), said damping element (181) preferably being an elastomer plug, said damping element (181) making it possible to avoid direct contact between a face of the extension opposite the firearm and said portion (290) when the base (110) is mounted on said firearm.

9. A firearm front sight (100) comprising a base (110) of one of clauses 1 to 8 and a sight (190) attached to said base (110).

10. A firearm adapted to receive the base (110) of one of the preceding clauses, characterized in that the muzzle (210) comprises an outer surface, a portion (232) of which, referred to as the "associated male portion", acts as an anti-rotation means when said base (110) is fitted on said muzzle (210), said female portion (132) of the base (110) and the associated male portion (232) of the muzzle (210)

providing a shaped connection preventing rotation between said base (110) and said muzzle (210) while ensuring sliding of said base (110) with respect to the muzzle (210).

11. The firearm of the preceding clause, characterized in that the associated male portion (232) that acts as an anti-rotation means comprises a first flattened area (234) and optionally a second flattened area (234'), preferably machined on the muzzle (210) of the barrel, and at least one cylindrical portion (233, 233').

12. The firearm of the preceding clause and adapted to receive the base (110) of one of clauses 5 to 8, characterized in that the associated male portion (232) that acts as an anti-rotation means of the muzzle (210) further comprises the track (234).

13. The firearm of clause 11 or 12 and adapted to receive the base (110) of one of clauses 5 to 7, characterized in that the first flattened area (234) of the muzzle (210) defines the track (234).

14. The firearm of one of clauses 10 to 13, characterized in that the muzzle (210) comprises an attachment interface (260), in particular a thread (260), adapted to attach an accessory, such as a muzzle brake or silencer, said firearm further comprising a protective ring (300) attached to the muzzle (210), in particular tightened on said thread (260), said firearm and said base (110) being adapted such that the protective ring (300) blocks the base (110) in translation.

15. A firearm of one of clauses 10 to 14, equipped with a base (110) of one of clauses 1 to 8, or with a front sight of clause 9.

The invention claimed is:

1. A firearm, comprising:

a barrel having a muzzle, wherein the muzzle comprises an outer surface defining a male portion and a track; and a front sight base, wherein the front sight base includes a body having an outer surface and an inner surface which defines a generally cylindrical cavity, the cavity being adapted to receive the muzzle, wherein the cavity of the base comprises a female portion that acts as an anti-rotation means when the base is fitted on the muzzle and is configured to provide a shaped connection between the female portion of the base and the male portion formed on the muzzle to prevent rotation between the base and the muzzle while ensuring sliding of the base with respect to the muzzle, the inner surface of the base comprising a first base sliding and anti-rotation guide surface, the base further comprising a retaining means configured to rigidly secure the base to the firearm, the retaining means comprising a pre-stressed retractable means adapted to be pressed onto the track formed on the muzzle of the firearm when the muzzle is fitted in the base, wherein the track is disposed opposite the first base sliding and anti-rotation guide surface of the inner surface of the base when the muzzle is fitted in the base;

wherein the track comprises a first track sliding and anti-rotation guide surface and at least one cylindrical portion, and the male portion further comprises a second track comprising a second track sliding and anti-rotation guide surface.

2. The firearm as claimed in claim 1, wherein the pre-stressed retractable means comprises a load spring including a leaf having a first portion configured to serve as an elastic element and a second portion configured to serve as a retaining element, the leaf being at least partially rolled up or curved, the base comprising a chamber in which the load spring is arranged, the chamber opening into the cavity.

3. The firearm as claimed in claim 1, wherein the pre-stressed retractable means comprises a leaf spring and a movable element configured to serve as a retaining element, the base further comprising a chamber in which the movable element and the spring are arranged, the chamber opening into the cavity.

4. The firearm as claimed in claim 1, wherein the track comprises a notch configured to act as a receptacle for the retaining means when the base is fitted on the muzzle.

5. The firearm as claimed in claim 1, wherein the track comprises a first track sliding and anti-rotation guide surface.

6. The firearm as claimed in claim 1, wherein the pre-stressed retractable means is a first pre-stressed retractable means, the retaining means comprises a second pre-stressed retractable means adapted to be pressed onto the second track when the muzzle is fitted in the base, and the second track is disposed opposite a second base sliding and anti-rotation guide surface of the inner surface of the base when the muzzle is fitted in the base.

7. The firearm as claimed in claim 1, comprising an extension toward a rear of the muzzle of the barrel, adapted to rest on a portion of the barrel, the extension comprising a damping element housed in the extension, the damping element configured to prevent direct contact between a face of the extension opposite the firearm and the portion when the base is mounted on the firearm.

8. The firearm as claimed in claim 1, wherein the track comprises a notch configured to act as a receptacle for a retaining element when the base is fitted on the muzzle.

9. The firearm as claimed in claim 1, wherein the muzzle comprises an attachment interface adapted to attach an accessory, the firearm further comprising a protective ring attached to the muzzle using the attachment interface, the firearm and the base being adapted such that the protective ring blocks the base in translation.

10. A firearm comprising:

a front sight base, the base being removable and comprising a body having an outer surface and an inner surface configured to receive a muzzle of a barrel of the firearm, the base comprising a retaining means configured to rigidly secure the base to the firearm, the inner surface comprising a female portion configured to act as an anti-rotation means, the base being configured to provide a shaped connection between the female portion of the base and an associated male portion formed on the muzzle to prevent rotation between the base and the muzzle while ensuring sliding of the base with respect to the muzzle when the base is not rigidly secured to the firearm by the retaining means, the inner surface of the base further comprising a first base sliding and anti-rotation guide surface, the muzzle comprising an outer surface defining a male portion configured to act as an anti-rotation means, the male portion comprising:

a first track comprising a first track sliding and anti-rotation guide surface, the retaining means comprising a pre-stressed retractable means adapted to be pressed onto the first track of the muzzle of the firearm, wherein the first track is disposed opposite the first base sliding and anti-rotation guide surface of the inner surface of the base.

11. The firearm as claimed in claim 10, wherein a second track is disposed opposite a second base sliding and anti-rotation guide surface of the inner surface of the base.

12. The firearm as claimed in claim 10, wherein the pre-stressed retractable means comprises a load spring including a leaf having a first portion configured to serve as an elastic element and a second portion configured to serve as a retaining element, the leaf being at least partially rolled up or curved, the base comprising a chamber in which the load spring is arranged, the chamber opening onto the first track.

13. The firearm as claimed in claim 10, wherein the pre-stressed retractable means comprises a spring including a leaf spring and a movable element configured to serve as a retaining element, the base further comprising a chamber in which the movable element and the spring are arranged, the chamber opening onto the first track.

14. The firearm as claimed in claim 10, wherein the first track comprises a notch configured to act as a receptacle for the retaining means.

15. The firearm as claimed in claim 10, wherein the pre-stressed retractable means is a first pre-stressed retractable means, the retaining means comprises a second pre-stressed retractable means adapted to be pressed onto a corresponding second track formed on the muzzle of the firearm.

16. The firearm as claimed in claim 15, wherein the second pre-stressed retractable means comprises a load spring including a leaf having a first portion configured to serve as an elastic element and a second portion configured to serve as a retaining element, the leaf being at least partially rolled up or curved, forming the retaining protrusion, the base comprising a chamber in which the load spring is arranged, the chamber opening onto the second track.

17. The firearm as claimed in claim 10, wherein the base comprises an extension toward a rear of the muzzle of the barrel, wherein the extension is adapted to rest on a portion of the barrel, the extension comprising a damping element housed in the extension and configured to prevent direct contact between a face of the extension opposite the firearm and the portion.

18. The firearm as claimed in claim 10, wherein the muzzle comprises an attachment interface adapted to attach an accessory, the firearm further comprising a protective ring attached to the muzzle by the attachment interface, the firearm and the base being adapted such that the protective ring blocks the base in translation.

19. The firearm as claimed in claim 10, wherein the first track extends longitudinally along the barrel and is configured to guide sliding of the base relative to the muzzle.

20. The firearm as claimed in claim 10, wherein the first track sliding and anti-rotation guide surface is directly engaged with the anti-rotation guide surface of the base.

21. The firearm as claimed in claim 10, wherein the retaining means is directly engaged with the first track.

22. A firearm, comprising:

a barrel that includes a muzzle, wherein the muzzle comprises an outer surface defining a male portion and a track; and a front sight base, wherein the front sight base includes a body having an outer surface and an inner surface which defines a generally cylindrical cavity, the cavity being adapted to receive the muzzle, wherein the cavity of the base comprises a female portion that acts as an anti-rotation means when the base is fitted on the muzzle and is configured to provide a shaped connection between the female portion of the base and the male portion formed on the muzzle to prevent rotation between the base and the muzzle while ensuring sliding of the base with respect to the muzzle, the inner surface of the base comprising a first base sliding and anti-rotation guide surface, the base further comprising a retaining means configured to rigidly secure the base to the firearm, the retaining means comprising a pre-stressed retractable means adapted to be pressed onto the track formed on the muzzle of the firearm when the muzzle is fitted in the base, wherein the track is disposed opposite the first base sliding and anti-rotation guide surface of the inner surface of the base when the muzzle is fitted in the base wherein the muzzle further comprises an attachment interface adapted to attach an accessory, the firearm further comprising a protective ring attached to the muzzle using the attachment interface, the firearm and the base being adapted such that the protective ring blocks the base in translation.

* * * * *